US007312008B2

(12) United States Patent
Wu et al.

(10) Patent No.: US 7,312,008 B2
(45) Date of Patent: Dec. 25, 2007

(54) HIGH-PERFORMANCE SURFACE LAYER FOR PHOTORECEPTORS

(75) Inventors: Jin Wu, Webster, NY (US); Yuhua Tong, Webster, NY (US); John J. Wilbert, Macedon, NY (US); Liang-bih Lin, Rochester, NY (US); Jennifer Y. Hwang, Penfield, NY (US); Timothy J. O'Brien, Rochester, NY (US); Anthony Uttaro, Jr., Rochester, NY (US); Linda L. Ferrarese, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 430 days.

(21) Appl. No.: 11/053,856

(22) Filed: Feb. 10, 2005

(65) Prior Publication Data

US 2006/0177748 A1 Aug. 10, 2006

(51) Int. Cl.
*G03G 15/04* (2006.01)

(52) U.S. Cl. ..... 430/66; 430/132; 430/58.2; 430/58.65; 399/159

(58) Field of Classification Search ..... 430/66, 430/132, 58.2, 58.65; 399/159
See application file for complete search history.

(56) References Cited

U.S. PATENT DOCUMENTS

| | | | |
|---|---|---|---|
| 3,121,006 | A | 2/1964 | Middleton et al. |
| 3,357,989 | A | 12/1967 | Byrne et al. |
| 3,442,781 | A | 5/1969 | Weinberger |
| 4,081,274 | A | 3/1978 | Horgan |
| 4,115,116 | A | 9/1978 | Stolka et al. |
| 4,233,384 | A | 11/1980 | Turner et al. |
| 4,265,990 | A | 5/1981 | Stolka et al. |
| 4,286,033 | A | 8/1981 | Neyhart et al. |
| 4,291,110 | A | 9/1981 | Lee |
| 4,299,897 | A | 11/1981 | Stolka et al. |
| 4,304,829 | A | 12/1981 | Limburg et al. |
| 4,306,008 | A | 12/1981 | Pai et al. |
| 4,338,387 | A | 7/1982 | Hewitt |
| 4,415,639 | A | 11/1983 | Horgan |
| 4,588,666 | A | 5/1986 | Stolka et al. |
| 4,647,521 | A | 3/1987 | Oguchi et al. |
| 4,664,995 | A | 5/1987 | Horgan et al. |
| 4,675,262 | A | 6/1987 | Tanaka |
| 4,678,731 | A | 7/1987 | Yoshizawa et al. |
| 4,713,308 | A | 12/1987 | Yoshizawa et al. |
| 4,717,637 | A | 1/1988 | Yoshizawa et al. |
| 4,784,928 | A | 11/1988 | Kan et al. |
| 4,855,203 | A | 8/1989 | Badesha et al. |
| 4,869,982 | A | 9/1989 | Murphy |
| 4,871,634 | A | 10/1989 | Limburg et al. |
| 5,008,167 | A | 4/1991 | Yu |
| 5,096,795 | A | 3/1992 | Yu |
| 5,484,867 | A | 1/1996 | Lichtenhan et al. |
| 5,521,047 | A | 5/1996 | Yuh et al. |
| 5,707,767 | A | 1/1998 | Yu |
| 5,709,974 | A | 1/1998 | Yuh et al. |
| 5,891,594 | A | 4/1999 | Yuh et al. |
| 5,939,576 | A | 8/1999 | Lichtenhan et al. |
| 6,214,514 | B1 | 4/2001 | Evans et al. |
| 7,108,947 | B2 * | 9/2006 | Wu et al. ..... 430/56 |
| 7,205,079 | B2 * | 4/2007 | Wu et al. ..... 430/58.05 |

* cited by examiner

*Primary Examiner*—Mark A. Chapman
(74) *Attorney, Agent, or Firm*—Oliff & Berridge, PLC

(57) ABSTRACT

An imaging member includes a substrate, a charge generating layer, and a charge transport layer, wherein an external of the imaging member includes a polyhedral oligomeric silsesquioxane modified silicone dispersed therein.

23 Claims, No Drawings

HIGH-PERFORMANCE SURFACE LAYER FOR PHOTORECEPTORS

BACKGROUND

The present disclosure relates to improved photoreceptor designs for electrostatographic printing devices, particularly photoreceptors having high-performance, long-life surface layers, thereby providing extended wear and improved operation. More particularly, the present disclosure relates to photoreceptors having modified silicone compounds incorporated in the surface layer, particularly to form an interpenetrating network layer.

In electrophotography, also known as Xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. In addition, the imaging member may be layered. Current layered organic imaging members generally have at least a substrate layer and two active layers. These active layers generally include (1) a charge generating layer containing a light-absorbing material, and (2) a charge transport layer containing charge transport molecules. These layers can be in any order, and sometimes can be combined in a single or mixed layer. The substrate layer may be formed from a conductive material. In addition, a conductive layer can be formed on a nonconductive substrate.

The charge generating layer is capable of photogenerating charge and injecting the photogenerated charge into the charge transport layer. For example, U.S. Pat. No. 4,855,203 to Badesha et al. teaches charge generating layers comprising a resin dispersed pigment. Suitable pigments include photoconductive zinc oxide or cadmium sulfide and organic pigments such as phthalocyanine type pigment, a polycyclic quinone type pigment, a perylene pigment, an azo type pigment and a quinacridone type pigment. Imaging members with perylene charge generating pigments, particularly benzimidazole perylene, show superior performance with extended life.

In the charge transport layer, the charge transport molecules may be in a polymer binder. In this case, the charge transport molecules provide hole or charge transport properties, while the electrically inactive polymer binder provides mechanical properties. Alternatively, the charge transport layer can be made from a charge transporting polymer such as poly(N-vinylcarbazole), polysilylene or polyether carbonate, wherein the charge transport properties are incorporated into the mechanically strong polymer.

Imaging members may also include a charge blocking layer and/or an adhesive layer between the charge generating layer and the conductive layer. In addition, imaging members may contain protective overcoatings. Further, imaging members may include layers to provide special functions such as incoherent reflection of laser light, dot patterns and/or pictorial imaging or subbing layers to provide chemical sealing and/or a smooth coating surface.

As more advanced, higher speed electrophotographic copiers, duplicators and printers have been developed, and as the use of such devices increases in both the home and business environments, degradation of image quality has been encountered during extended cycling. Moreover, complex, highly sophisticated duplicating and printing systems operating at very high speeds have placed stringent requirements upon component parts, including such constraints as narrow operating limits on the photoreceptors. For example, the numerous layers found in many modern photoconductive imaging members must be highly flexible, adhere well to adjacent layers, and exhibit predictable electrical characteristics within narrow operating limits to provide excellent toner images over many thousands of cycles. One type of multilayered photoreceptor that has been employed for use as a belt or as a roller in electrophotographic imaging systems comprises a substrate, a conductive layer, a blocking layer, an adhesive layer, a charge generating layer, a charge transport layer and a conductive ground strip layer adjacent to one edge of the imaging layers. This photoreceptor may also comprise additional layers such as an anti-curl back coating and an optional overcoating layer.

Imaging members are generally exposed to repetitive electrophotographic cycling, which subjects the exposed charge transport layer thereof to abrasion, chemical attack, heat and multiple exposures to light. This repetitive cycling leads to a gradual deterioration in the mechanical and electrical characteristics of the exposed charge transport layer. Attempts have been made to overcome these problems. However, the solution of one problem often leads to additional problems.

U.S. Pat. Nos. 5,096,795 and 5,008,167 disclose electrophotographic imaging devices, where the exposed layer has particles, such as metal oxide particles, homogeneously dispersed therein. The particles provide coefficient of surface contact friction reduction, increased wear resistance, durability against tensile cracking, and improved adhesion of the layers without adversely affecting the optical and electrical properties of the imaging member.

U.S. Pat. No. 5,707,767 discloses an electrophotographic imaging member including a supporting substrate having an electrically conductive surface, a hole blocking layer, an optional adhesive layer, a charge generating layer, a charge transport layer, an optional anticurl back coating, a ground strip layer and an optional overcoating layer. At least one of the charge transport layer, anticurl back coating, ground strip layer and overcoating layer includes silica particle clusters homogeneously distributed in a film forming matrix.

U.S. Pat. No. 4,869,982 discloses an electrophotographic photoreceptor containing a toner release material in a charge transport layer. From about 0.5 to about 20 percent of a toner release agent selected from stearates, silicon oxides and fluorocarbons is incorporated into a charge transport layer.

U.S. Pat. No. 4,784,928 discloses an electrophotographic element having two charge transport layers. An outermost charge transport layer or overcoating may comprise a waxy spreadable solid, stearates, polyolefin waxes, and fluorocarbon polymers such as Vydax fluorotelomer from du Pont and Polymist F5A from Allied Chemical Company.

U.S. Pat. No. 4,664,995 discloses an electrostatographic imaging member utilizing a ground strip. The disclosed ground strip material comprises a film forming binder, conductive particles and microcrystalline silica particles dispersed in the film forming binder, and a reaction product of a bi-functional chemical coupling agent that interacts with both the film forming binder and the microcrystalline silica particles.

U.S. Pat. No. 4,717,637 discloses a microcrystalline silicon barrier layer.

U.S. Pat. Nos. 4,678,731 and 4,713,308 disclose microcrystalline silicon in the photoconductive and barrier layers of a photosensitive member.

U.S. Pat. No. 4,675,262 discloses a charge transport layer containing powders having a different refractive index than that of the charge transport layer excluding the powder material. The powder materials include various metal oxides.

U.S. Pat. No. 4,647,521 discloses the addition of amorphous hydrophobic silica powder to the top layer of a photosensitive member. The silica is of spherical shape and has a size distribution between 10 and 1000 Angstroms. Hydrophobic silica is a synthetic silica having surface silanol (SiOH) groups replaced by hydrophobic organic groups such as $—CH_3$.

SUMMARY

Despite the various known photoreceptor designs, there is a continued need in the art for improved photoreceptor packages. For example, there remains a need in the art for longer-lasting photoreceptors while providing lower operating costs. In particular, there is a need in the art for lower operating cost electrostatographic printing devices, where lower costs are derived from improved photoreceptor designs. Such improved photoreceptor designs should include increased wear resistance, i.e., low photoreceptor wear, while still providing improved toner transfer, improved cleaning properties, lower toner adhesion, and the like.

The present disclosure addresses these and other needs by providing a photoreceptor having improved wear and scratch resistance. These benefits are provided by incorporating a modified silicone compound in the charge transport layer, or other external layer of the photoreceptor such as an overcoat layer.

In particular, the present disclosure provides an imaging member comprising:

a substrate, a charge generating layer, and a charge transport layer, wherein an external layer of said imaging member comprises a polyhedral oligomeric silsesquioxane modified silicone dispersed therein.

The present disclosure also provides a method for making such an imaging member, generally comprising:

providing an imaging member substrate, and applying at least a charge generating layer and a charge transport layer to said substrate, wherein an external layer of said imaging member comprises a polyhedral oligomeric silsesquioxane modified silicone dispersed therein.

DETAILED DESCRIPTION OF PREFERRED EMBODIMENTS

The present disclosure relates to imaging members having improved wear and scratch resistance, and to methods of forming such imaging members.

According to embodiments of the present disclosure, an electrophotographic imaging member is provided, which generally comprises at least a substrate layer, a charge generating layer, and a charge transport layer. The charge generating layer and the charge transport layer can, in embodiments, be combined in a single layer. This imaging member can be employed in an imaging process comprising providing the electrophotographic imaging member, depositing a uniform electrostatic charge on the imaging member with a corona charging device, exposing the imaging member to activating radiation in image configuration to form an electrostatic latent image on the imaging member, developing the electrostatic latent image with electrostatically attractable toner particles to form a toner image, transferring the toner image to a receiving member and repeating the depositing, exposing, developing and transferring steps. These imaging members may be fabricated by any of the various known methods.

In general, electrostatographic imaging members are well known in the art. An electrostatographic imaging member, including the electrostatographic imaging member of the present disclosure, may be prepared by any of the various suitable techniques, provided that the material being applied as the charge transport or external overcoat layer includes the wear and scratch resistant interpenetrating network materials, described below. Suitable conventional photoreceptor designs that can be modified in accordance with the present disclosure include, but are not limited to, those described for example in U.S. Pat. Nos. 4,647,521, 4,664,995, 4,675,262, 4,678,731, 4,713,308, 4,717,637, 4,784,928, 4,869,982, 5,008,167, 5,096,795, and 5,707,767, the entire disclosures of which are incorporated herein by reference.

According to the present disclosure, the charge transport layer, or other external layer such as an optional overcoat layer, includes a wear and/or scratch resistant imparting material, which preferably forms an interpenetrating network in the layer. Typically, a flexible or rigid substrate is provided having an electrically conductive surface. A charge generating layer is then usually applied to the electrically conductive surface. An optional charge blocking layer may be applied to the electrically conductive surface prior to the application of the charge generating layer. If desired, an adhesive layer may be utilized between the charge blocking layer and the charge generating layer. Usually the charge generation layer is applied onto the blocking layer and a charge transport layer is formed on the charge generation layer. However, in some embodiments, the charge transport layer may be applied prior to the charge generation layer.

Preferably, the wear and/or scratch resistance imparting material is a polyhedral oligomeric silsesquioxane (POSS) modified silicone. Generally, as will be described in more detail below, the polyhedral oligomeric silsesquioxane (POSS) modified silicone can be made by various methods, including by the hydrosilation reaction of a vinyl-substituted POSS monomer with a hydridosilane, or by the peroxide activated cure reaction of a vinyl-substituted POSS monomer with a polysiloxane, or a vinyl-terminated polysiloxane, or a siloxane-vinyl-terminated siloxane copolymer, or by the sol-gel reaction of an alkoxysilane-substituted POSS or a silanol-substituted POSS or a chlorosilane-substituted POSS with an alkoxysilane or a chlorosilane or a silanol-terminated polysiloxane. The polyhedral oligomeric silsesquioxane (POSS) modified silicone can be produced separately and then introduced into an imaging member coating solution, or the precursor materials for the polyhedral oligomeric silsesquioxane (POSS) modified silicone and optional catalyst can be added to the imaging member coating solution and the polyhedral oligomeric silsesquioxane (POSS) modified silicone can be formed in situ with the coating solution.

Polyhedral oligomeric silsesquioxane, or POSS, is a recently developed advanced material that has several unique features. First, the chemical composition of POSS is a hybrid intermediate having a general formula $RSiO_{1.5}$, which is between that of silica ($SiO_2$) and silicones (RSiO). Second, POSS molecules approximately range in size from about 0.7 to about 50 nm, which are larger than conventional small molecules but are smaller than conventional macromolecules. POSS materials are also thermally and chemically more robust than silicones, and their nano-structured shape and size provide unique properties by controlling polymeric chain motion at the molecular level. POSS is also called "T resin," indicating that there are three (tri-substituted) oxygens substituting the silicon.

In investigating the use of POSS materials in imaging member design, it was found that that certain POSS modified silicones can impart significant advantages to the imaging member structure and properties. However, it was also found that in order to introduce the POSS materials into imaging member layers and make an interpenetrating network, compatible or semi-compatible non-POSS co-monomers must be introduced with the POSS materials. For example, the compatibility of POSS monomers can be dependent upon such variables as the nature of the organic ligands, the type of reactive functionality, the symmetry of the POSS monomer, and the like. The usefulness of the POSS monomers in forming a POSS modified silicone for use in imaging members also relies upon such factors as the optical clarity of the final product and the final layer, the lack of generation of unwanted by-products in the hydrosilation reaction, the compatibility of the resultant POSS modified silicone with the other layer materials, and the like.

Based on the investigations of the present inventors, one suitable combination of POSS materials and non-POSS monomers was found to be a vinyl substituted POSS and hydridosilane. The bond forming chemistry is the platinum catalyzed hydrosilation reaction in an addition cure process. Reaction of these materials provides a POSS modified silicone that is optically clear and partially compatible with the charge transport and/or overcoating layers materials when introduced into an imaging member layer. These materials have also been found to provide good coating uniformity, particularly due to the lack of generation of unwanted reaction by-products. Another suitable combination was found to be a vinyl-substituted POSS and polydiorganosiloxane. In this peroxide activated cure process, peroxides induce free radical coupling between vinyl groups of vinyl substituted POSS and methyl groups of polydiorganosiloxane. Concomitant and subsequent reactions take place among methyl groups and between crosslink sites and methyl groups. Yet another suitable combination was found to be an alkoxysilane-substituted POSS or a silanol-substituted POSS or a chlorosilane-substituted POSS with an alkoxysilane or a chlorosilane or a silanol-terminated polysiloxane. The sol-gel process includes two distinct steps, and they are hydrolysis and condensation.

The POSS materials utilized in the present compositions has the general formula $(RSiO_{1.5})_n$ where n is an even number and R is selected from the group consisting of substituted or unsubstituted aliphatic or aromatic hydrocarbon groups, preferably having from one to about thirty carbon atoms. These POSS materials have the following general structure:

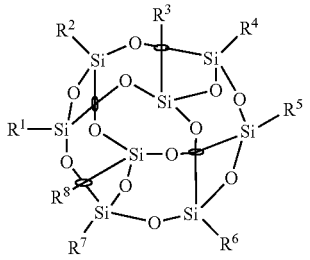

where n is an even number and R is the same or different at each occurrence and is selected from the group consisting of substituted or unsubstituted aliphatic or aromatic hydrocarbon groups, preferably having from one to about thirty carbon atoms, more preferably from about 2 to about 20 carbon atoms, and most preferably from about 4 to about 12 carbon atoms. The hydrocarbon groups can be cyclic, branched or straight chained. The hydrocarbon groups can be saturated or may contain unsaturation. The hydrocarbon groups can be unsubstituted or substituted with one or more groups selected from the group consisting of methyl, ethyl, isobutyl, isooctyl, cyclopentyl, cyclohexyl, vinyl, styrl, trimethylsiloxyl, trichlorosilylethyl, trichlorosilylpropyl, dichlorosilylethyl, chlorosilylethyl, phenyl, chlorobenzyl, cyanoethyl, cyanopropyl, norbomenyl, fluoro, silanol, dimethylsilane, alkoxy, methacrylate, silane, aniline, amine, phenol, and alcohol. In certain embodiments, the hydrocarbon group is partially fluorinated or perfluorinated. Suitable R groups include, for example, cyclohexyl, cyclopentyl, methyl, isobutyl, octamethyl and octaisobutyl groups.

The POSS molecules can be prepared by processes known to one skilled in the art, such as, for example, the processes taught by U.S. Pat. Nos. 5,484,867 and 5,939,576, the entire disclosures of which are incorporated herein by reference. For example, U.S. Pat. No. 5,484,867 discloses a process for the preparation of reactive POSS monomers that can be chemically reacted with oligomers, polymers, catalysts or co-monomers to form polyhedral silsesquioxane polymers containing silsesquioxanes as pendant, block, or end group segments. As another example, U.S. Pat. No. 5,939,576 discloses a process for the preparation of reactive POSS by metal catalyzed hydrosilylation reactions of silane containing POSS with olefinic reagents bearing functionalities useful for grafting reactions, polymerization chemistry and sol-gel process. The functionalized POSS monomers prepared by the above two patents are used to prepare polymer systems according to the present disclosure. Suitable POSS materials can be obtained from commercial sources such as Hybrid Plastics, Inc. (Fountain Valley, Calif., USA).

Although not limited to any particular materials, suitable POSS monomers include vinyl substituted POSS. A specific example of such a suitable material includes, but is not limited to, the vinyl substituted POSS monomer available as OL1160 and OL1170 from Hybrid Plastics, Inc. The OL1160 monomer is a monodisperse octamer containing eight reactive vinyl groups, while the OL1170 is a polydisperse mixture of octamer, decamer and dodecamer. However, the particular POSS materials are not limited to these materials, and other suitable POSS materials can be used, as desired.

The POSS modified silicones of the present disclosure can be made by reacting the above POSS material with a suitable hydridosilane or a polysiloxane containing hydride functional groups. Suitable hydridosilanes include, but are not limited to, hydridosilanes of the following formula:

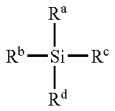

where each of $R^a$, $R^b$, $R^c$, and $R^d$ is, independently, H, linear $C_{1-30}$ alkyl, branched $C_{1-30}$ alkyl, cyclic $C_{3-30}$ alkyl, linear $C_{2-30}$ alkenyl, branched $C_{2-30}$ alkenyl, linear $C_{2-30}$ alkynyl, branched $C_{2-30}$ alkynyl, $C_{6-20}$ aralkyl, $C_{6-10}$ aryl, or a polymeric moiety having a molecular weight of about 1000 to about 100,000. The polymeric moiety can be selected from the group consisting of hydrocarbon polymers, polyesters, polyamides, polyethers, polyacrylates, polyurethanes, epoxies, and polymethacrylates. each of $R^a$, $R^b$, $R^c$, and $R^d$ is optionally substituted with one or more substituents selected from the group consisting of —F, —Cl, —Br, —CN, $—NO_2$, =O, —N=C=O, —N=C=S,

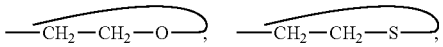

$—N_3$, $—NR^eR^f$, $—SR^g$, $—OR^h$, $—CO_2R^i$, $—PR^jR^kR^l$, $—P(OR^m)(OR^n)(OR^p)$, $—P(=O)(OR^q)(OR^s)$, $—P(=O)_2OR^t$, $—OP(=O)_2OR^u$, $—S(=O)_2R^v$, $—S(=O)R^w$, $—S(=O)_2OR^x$, $—C(=O)NR^yR^z$, and $—OSiR^{aa}R^{bb}R^{cc}$. Each of $R^e$, $R^f$, $R^g$, $R^h$, $R^i$, $R^j$, $R^k$, $R^l$, $R^m$, $R^n$, $R^p$, $R^q$, $R^s$, $R^t$, $R^u$, $R^v$, $R^w$, $R^x$, $R^y$, and $R^z$, is, independently, H, linear $C_{1-10}$ alkyl, branched $C_{1-10}$ alkyl, cyclic $C_{3-8}$ alkyl, linear $C_{2-10}$ alkenyl, branched $C_{2-10}$ alkenyl, linear $C_{2-10}$ alkynyl, branched $C_{2-10}$ alkynyl, $C_{6-12}$ aralkyl, or $C_{6-10}$ aryl, and is optionally substituted with one or more substituents selected from the group consisting of —F, —Cl, and —Br. Each of $R^{aa}$, $R^{bb}$, and $R^{cc}$ is, independently, linear $C_{1-10}$ alkyl, branched $C_{1-10}$ alkyl, cyclic $C_{3-8}$ alkyl, linear $C_{2-10}$ alkenyl, branched $C_{2-10}$ alkenyl, linear $C_{2-10}$ alkynyl, branched $C_{2-10}$ alkynyl, $C_{6-12}$ aralkyl, $C_{6-10}$ aryl, —F, —Cl, —Br, or $OR^{dd}$, where $R^{dd}$ is linear $C_{1-10}$ alkyl or branched $C_{1-10}$ alkyl. At least one of $R^a$, $R^b$, $R^c$, and $R^d$ is H and at least one of $R^a$, $R^b$, $R^c$, and $R^d$ is not H. Preferably, two or three of $R^a$, $R^b$, $R^c$, and $R^d$ are H.

Particular suitable hydridosilanes include, but are not limited to, phenyltris(dimethylsilyloxy)silane. This corresponds to the above formula where one of $R^a$, $R^b$, $R^c$, and $R^d$ is unsubstituted phenyl and the remaining $R^a$, $R^b$, $R^c$, and $R^d$ are dimethylsilyloxy groups. Other suitable hydridosilanes include tris(dimethylsilyloxy)methylsilane, 1,3-dicyclohexyl-1,1,3,3-tetrakis(dimethylsilyloxy)disiloxane, 1,1,3,3-tetramethyldisiloxane, 1,1,3,3,5,5-hexamethyltrisiloxane, 1,4-bis(dimethylsilyl)benzene, and the like. Suitable polysiloxane polymers containing hydride functional groups include, but not limited to, hydride-terminated polydimethylsiloxane, methylhydrosiloxane-dimethylsiloxane copolymer, polymethylhydrosiloxane, polyethylhydrosiloxane, hydride-terminated polyphenyl (dimethylhydrosiloxy)siloxane, hydride-terminated methylhydrosiloxane-phenylmethylsiloxane copolymer, methylhydrosiloxane-octylmethylsiloxane copolymer, hydride Q resin, and the like.

As described above, the POSS modified silicones of the present disclosure can be formed by a hydrosilation reaction of the POSS material and the hydridosilane. As is known in the art, such reactions can be conducted in the presence of a catalyst, such as a platinum carbonyl cyclovinylmethylsiloxane complex, or a platinum divinyltetramethyldisiloxane complex, under appropriate reaction conditions such as elevated temperature. In principle, the reaction of hydride functional siloxanes with vinyl functional POSS takes place at 1:1 stoichiometry. The optimal cure ratio can vary and is usually determined by measuring the hardness of cured system at different ratios. The optimal ratio can be determined by both electrical responses and wear resistance of photoreceptors. The reaction can be carried out separately from other coating components, or it can be conducted in situ in the presence of other coating components, as desired.

In this reaction, the theoretical hydride to vinyl ratio is 1:1. However, different ratios are preferred to ensure a desired reaction product, and to account for divergence from theoretical reaction conditions. Thus, for example, the ratio can be adjusted to be greater than 1:1, such as from about 1.3:1 to about 4.5:1, for example to account for impurities, presence of moisture, and the like.

The weight ratio of POSS versus silicone in the POSS modified silicones is determined by the initial material feed so that the hydride of hydridosilane to vinyl of vinyl-substituted POSS ratio varies from about 1:1 to about 4.5:1, preferably from about 1.3:1 to about 3.0:1, and even more preferably from about 1.3:1 to about 2:1.

In embodiments of the present disclosure, the POSS modified silicone is preferably included in the respective layer, usually the charge transport layer or an overcoat layer, in an amount of from about 1 to about 30 percent by weight of the layer. Preferably, the POSS modified silicone is included in an amount of from about 5 to about 20 percent, and more preferably from about 10 to about 15 percent, by weight of the layer.

Furthermore, in embodiments, it is preferred that the POSS modified silicone is dispersed uniformly, or at least substantially so, in the respective layer. Uniform dispersion of the POSS modified silicone helps to assure uniform imaging properties as the layer wears down over use.

The particular construction of an exemplary imaging member will now be described in more detail. However, the following discussion is of only one embodiment, and is not limiting of the disclosure.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including, but not limited to, polyesters, polycarbonates, polyamides, polyurethanes, mixtures thereof, and the like. As electrically conductive materials there may be employed various resins that incorporate conductive particles, including, but not limited to, resins containing an effective amount of carbon black, or metals such as copper, aluminum, nickel, and the like. The substrate can be of either a single layer design, or a multi-layer design including, for example, an electrically insulating layer having an electrically conductive layer applied thereon.

The electrically insulating or conductive substrate is preferably in the form of a rigid cylinder, drum or belt. In the case of the substrate being in the form of a belt, the belt can be seamed or seamless, with a seamless belt being particularly preferred.

The thickness of the substrate layer depends on numerous factors, including strength and rigidity desired and economical considerations. Thus, this layer may be of substantial thickness, for example, about 5000 micrometers or more, or of minimum thickness of less than or equal to about 150 micrometers, or anywhere in between, provided there are no adverse effects on the final electrostatographic device. The surface of the substrate layer is preferably cleaned prior to coating to promote greater adhesion of the deposited coating. Cleaning may be effected by any known process including, for example, by exposing the surface of the substrate layer to plasma discharge, ion bombardment and the like.

The conductive layer may vary in thickness over substantially wide electrostatographic member. Accordingly, for a photoresponsive imaging device having an electrically insulating, transparent cylinder, the thickness of the conductive layer may be between about 10 angstrom units to about 500 angstrom units, and more preferably from about 100 Angstrom units to about 200 angstrom units for an optimum combination of electrical conductivity and light transmission. The conductive layer may be an electrically conductive metal layer formed, for example, on the substrate by any suitable coating technique, such as a vacuum depositing technique. Typical metals include, but are not limited to, aluminum, zirconium, niobium, tantalum, vanadium and hafnium, titanium, nickel, stainless steel, chromium, tungsten, molybdenum, mixtures thereof, and the like. In general, a continuous metal film can be attained on a suitable substrate, e.g. a polyester web substrate such as Mylar available from E.I. du Pont de Nemours & Co., with magnetron sputtering.

If desired, an alloy of suitable metals may be deposited. Typical metal alloys may contain two or more metals such as zirconium, niobium, tantalum, vanadium and hafnium, titanium, nickel, stainless steel, chromium, tungsten, molybdenum, and the like, and mixtures thereof. Regardless of the technique employed to form the metal layer, a thin layer of metal oxide generally forms on the outer surface of most metals upon exposure to air. Thus, when other layers overlying the metal layer are characterized as "contiguous" (or adjacent or adjoining) layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 7000 Angstroms or a conductive carbon black dispersed in a plastic binder as an opaque conductive layer. A typical electrical conductivity for conductive layers for electrophotographic imaging members in slow speed copiers is about $10^2$ to $10^3$ ohms/square.

After formation of an electrically conductive surface, a hole blocking layer may optionally be applied thereto for photoreceptors. Generally, electron blocking layers for positively charged photoreceptors allow holes from the imaging surface of the photoreceptor to migrate toward the conductive layer. For negatively charged photoreceptors, the blocking layer allows electrons to migrate toward the conducting layer. Any suitable blocking layer capable of forming an electronic barrier to holes between the adjacent photoconductive layer and the underlying conductive layer may be utilized. The blocking layer may include film forming polymers, such as nylon, epoxy and phenolic resins. The polymeric blocking layer may also contain metal oxide particles, such as titanium dioxide or zinc oxide. The blocking layer may also include, but is not limited to, nitrogen containing siloxanes or nitrogen containing titanium compounds such as trimethoxysilyl propylene diamine, hydrolyzed trimethoxysilyl propyl ethylene diamine, N-beta(aminoethyl) gamma-amino-propyl trimethoxy silane, isopropyl 4-aminobenzene sulfonyl, di(dodecylbenzene sulfonyl)titanate, isopropyl di(4-aminobenzoyl)isostearoyl titanate, isopropyl tri(N-ethylaminoethylamino)titanate, isopropyl trianthranil titanate, isopropyl tri(N,N-dimethyl-ethylamino)titanate, titanium-4-amino benzene sulfonat oxyacetate, titanium 4-aminobenzoate isostearate oxyacetate, $[H_2N(CH_2)_4]CH_3Si(OCH_3)_2$, (gamma-aminobutyl)methyl diethoxysilane, $[H_2N(CH_2)_3]CH_3Si(OCH_3)_2$ (gamma-aminopropyl) methyl diethoxysilane, mixtures thereof, and the like, as disclosed in U.S. Pat. Nos. 4,291,110, 4,338,387, and 4,286,033, the entire disclosures of which are incorporated herein by reference. A preferred blocking layer comprises a reaction product between a hydrolyzed silane and the oxidized surface of a metal ground plane layer. The oxidized surface inherently forms on the outer surface of most metal ground plane layers when exposed to air after deposition.

The blocking layer can be further doped with fillers, such as metal oxides, to improve its functionality. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like.

The blocking layers should be continuous and have a thickness of less than about 15 micrometer because greater thicknesses may lead to undesirably high residual voltage.

An optional adhesive layer may be applied to the hole blocking layer. Any suitable adhesive layer well known in the art may be utilized. Typical adhesive layer materials include, for example, but are not limited to, polyesters, dupont 49,000 (available from E.I. dupont de Nemours and Company), Vitel PE100 (available from Goodyear Tire & Rubber), polyurethanes, and the like. Satisfactory results may be achieved with adhesive layer thickness between about 0.05 micrometer (500 angstrom) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable photogenerating layer may be applied to the adhesive or blocking layer, which in turn can then be overcoated with a contiguous hole (charge) transport layer as described hereinafter. Examples of typical photogenerating layers include, but are not limited to, inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from Dupont under the tradename Monastral Red, Monastral violet and Monastral Red Y, Vat orange 1 and Vat orange 3 trade names for dibromo anthanthrone pigments, benzimidazole perylene, perylene pigments as disclosed in U.S. Pat. No. 5,891,594, the entire disclosure of which is incorporated herein by reference, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of which is incorporated herein by reference. Other suitable photogenerating materials known in the art may also be utilized, if desired.

Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and selenium tellurium alloys are also preferred because these materials provide the additional benefit of being sensitive to infra-red light.

Any suitable polymeric film forming binder material may be employed as the matrix in the photogenerating binder layer. Typical polymeric film forming materials include, but are not limited to, those described, for example, in U.S. Pat. No. 3,121,006, the entire disclosure of which is incorporated herein by reference. Thus, typical organic polymeric film forming binders include, but are not limited to, thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, mixtures thereof, and the like. These polymers may be block, random or alternating copolymers.

The photogenerating composition or pigment may be present in the resinous binder composition in various amounts. Generally, however, the photogenerating composition or pigment may be present in the resinous binder in an amount of from about 5 percent by volume to about 90 percent by volume of the photogenerating pigment dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The photogenerating layer thickness is generally related to binder content. Thus, for example, higher binder content compositions generally require thicker layers for photogeneration. Thickness outside these ranges can be selected providing the objectives of the present disclosure are achieved.

Any suitable and conventional technique may be utilized to mix and thereafter apply the photogenerating layer coating mixture. Typical application techniques include spraying, dip coating, roll coating, wire wound rod coating, and the like. Drying of the deposited coating may be effected by any suitable conventional technique such as oven drying, infrared radiation drying, air-drying and the like.

The electrophotographic imaging member of the present disclosure generally contains a charge transport layer in addition to the charge generating layer. The charge transport layer comprises any suitable organic polymer or non-polymeric material capable of transporting charge to selectively discharge the surface charge. Charge transporting layers may be formed by any conventional materials and methods, such as the materials and methods disclosed in U.S. Pat. No. 5,521,047 to Yuh et al., the entire disclosure of which is incorporated herein by reference. In addition, the charge transporting layers may be formed as an aromatic diamine dissolved or molecularly dispersed in an electrically inactive polystyrene film forming binder, such as disclosed in U.S. Pat. No. 5,709,974, the entire disclosure of which is incorporated herein by reference.

The charge transport layer of the disclosure generally includes at least a binder and at least one arylamine charge transport material. The binder should eliminate or minimize crystallization of the charge transport material and should be soluble in a solvent selected for use with the composition such as, for example, methylene chloride, chlorobenzene, tetrahydrofuran, toluene or another suitable solvent. Suitable binders may include, for example, polycarbonates, polyesters, polyarylates, polyacrylates, polyethers, polysulfones and mixtures thereof. For the preferred solvent of methylene chloride and the preferred charge transport materials, the binder is preferably a polycarbonate. Although any polycarbonate binder may be used, preferably the polycarbonate is either a bisphenol Z polycarbonate or a biphenyl A polycarbonate. Example biphenyl A polycarbonates are the MAKROLON® polycarbonates. Example bisphenol Z polycarbonates are the LUPILON® polycarbonates, also widely identified in the art as PCZ polycarbonates, e.g., PCZ-800, PCZ-600, PCZ-500 and PCZ-400 polycarbonate resins and mixtures thereof.

As the charge transport materials, at least one of the charge transport materials generally comprises an arylamine compound. Arylamine charge transport materials can be subdivided into monoamines, diamines, triamines, etc. Examples of aryl monoamines include: bis(4-methylphenyl)-4-biphenylylamine, bis(4-methoxyphenyl)-4-biphenylylamine, bis-(3-methylphenyl)-4-biphenylylamine, bis(3-methoxyphenyl)-4-biphenylylamine-N-phenyl-N-(4-biphenylyl)-p-toluidine, N-phenyl-N-(4-biphenylyl)-p-toluidine, N-phenyl-N-(4-biphenylyl)-m-anisidine, bis(3-phenyl)-4-biphenylylamine, N,N,N-tri[3-methylphenyl]

amine, N,N,N-tri[4-methylphenyl]amine, N,N-di(3-methylphenyl)-p-toluidine, N,N-di(4-methylphenyl)-m-toluidine, bis-N,N-[(4'-methyl-4-(1,1'-biphenyl)]-aniline, bis-N,N-[(2'-methyl-4(1,1'-biphenyl)]-aniline, bis-N,N-[(2'-methyl-4(1,1'-biphenyl)]-p-toluidine, bis-N,N-[(2'-methyl-4(1,1'-biphenyl)]-m-toluidine, and N,N-di-(3,4-dimethylphenyl)4-biphenylamine (DBA), and mixtures thereof. Examples of aryl diamines include: those described in U.S. Pat. Nos. 4,306,008, 4,304,829, 4,233,384, 4,115,116, 4,299,897, 4,265,990, 4,081,274 and 6,214,514, each incorporated herein by reference. Typical aryl diamine transport compounds include N,N'-diphenyl-N,N'-bis(alkylphenyl)-[1,1'-biphenyl]-4,4'-diamine wherein the alkyl is linear such as for example, methyl, ethyl, propyl, n-butyl and the like, N,N'-diphenyl-N,N'-bis(3-methylphenyl)-[1,1'-biphenyl]-4,4'-diamine, N,N'-diphenyl-N,N'-bis(3-hydroxyphenyl)-(1,1'-biphenyl)-4,4'-diamine, N,N'-diphenyl-N,N'-bis(4-methylphenyl)-[1,1'-biphenyl]-4,4'-diamine, N,N'-diphenyl-N,N'-bis(2-methylphenyl)-[1,1'-biphenyl]-4,4'-diamine, N,N'-diphenyl-N,N'-bis(3-ethylphenyl)-[1,1'-biphenyl]-4,4'-diamine, N,N'-diphenyl-N,N'-bis(4-ethylphenyl)-[1,1'-biphenyl]-4,4'-diamine, N,N'-diphenyl-N,N'-bis(4-n-butylphenyl)-[1,1'-biphenyl]-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4-diamine, N,N'-diphenyl-N,N'-bis(phenylmethyl)-[1,1'-biphenyl]-4,4'-diamine, N,N,N,N'-tetraphenyl-[2,2'-dimethyl-1,1'-biphenyl]-4,4'-diamine, N,N,N,N'-tetra(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]4,4'-diamine, N,N'-diphenyl-N,N'-bis(2-methylphenyl)-[2,2'-dimethyl-1,1'-biphenyl]4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, mixtures thereof and the like.

Typically, the charge transport material is present in the charge transport layer in an amount of from about 5 to about 80 percent by weight, and preferably from about 25 to about 75 percent by weight, and the binder is present in an amount of from about 20 to about 95 percent by weight, and preferably from about 25 to about 75 percent by weight, although the relative amounts can be outside these ranges.

As described above, the charge transport layer of the present disclosure, particularly when it is the external layer of the imaging member, also includes a POSS modified silicone. The POSS modified silicone can be suitably mixed with the other components of the charge transport layer for application to the imaging member if the POSS modified silicone has already been formed, or the precursor materials of the POSS modified silicone can be mixed with the other coating materials and applied as a coating solution in which the precursor materials react to form the POSS modified silicone.

Any suitable and conventional technique may be utilized to mix and thereafter apply the charge transport layer coating mixture to the charge generating layer. Typical application techniques include spraying, dip coating, roll coating, wire wound rod coating, and the like. Preferably, the coating mixture of the transport layer comprises between about 9 percent and about 12 percent by weight binder, between about 27 percent and about 3 percent by weight charge transport material, between about 64 percent and about 85 percent by weight solvent for dip coating applications, and between about 3 and about 20 percent by weight of hydrophobic silica, as described above. Drying of the deposited coating may be effected by any suitable conventional technique such as oven drying, infra-red radiation drying, air drying and the like.

Generally, the thickness of the charge transport layer is between about 10 and about 50 micrometers, but thicknesses outside this range can also be used. The charge transport layer should preferably be an insulator to the extent that the electrostatic charge placed on the charge transport layer is not conducted in the absence of illumination at a rate sufficient to prevent formation and retention of an electrostatic latent image thereon. In general, the ratio of thickness of the charge transport layer to the charge generator layer is preferably maintained from about 2:1 to 200:1 and in some instances as great as 400:1. In other words, the charge transport layer is substantially non-absorbing to visible light or radiation in the region of intended use but is "active" in that it allows the injection of photogenerated holes from the photoconductive layer, i.e., charge generation layer, and allows these holes to be transported through the active charge transport layer to selectively discharge a surface charge on the surface of the active layer.

An optional overcoat layer may be applied over the charge transport layer. The overcoat layer may comprise, for example, a dihydroxy arylamine dissolved or molecularly dispersed in a polyamide matrix. The overcoat layer may be formed from a coating composition comprising an alcohol soluble film forming polyamide and a dihydroxy arylamine.

In these embodiments, any suitable alcohol soluble polyamide film forming binder capable of forming hydrogen bonds with the hydroxy functional materials may be utilized in the overcoating. The expression "hydrogen bonding" is defined as the attractive force or bridge occurring between the polar hydroxy containing aryl-amine and a hydrogen bonding resin in which the hydrogen atom of the polar hydroxy arylamine is attracted to two unshared electrons of a resin containing polarizable groups. The hydrogen atom is the positive end of one polar molecule and forms a linkage with the electronegative end of the polar molecule. The polyamide utilized in the overcoatings should also have sufficient molecular weight to form a film upon removal of the solvent and also be soluble in alcohol. Generally, the weight average molecular weights of polyamides vary from about 5,000 to about 1,000,000. Since some polyamides absorb water from the ambient atmosphere, its electrical property may vary to some extent with changes in humidity in the absence of a polyhydroxy arylamine charge transporting monomer, the addition of charge transporting polyhydroxy arylamine minimizes these variations. The alcohol soluble polyamide should be capable of dissolving in an alcohol solvent, which also dissolves the hole transporting small molecule having multi hydroxy functional groups. The polyamides polymers required for the overcoatings are characterized by the presence of amide groups, —CONH. Typical polyamides include the various Elvamide resins, which are nylon multipolymer resins, such as alcohol soluble Elvamide and Elvamide TH Resins. Elvamide resins are available from E.I. Dupont Nemours and Company. Other examples of polyamides include Elvamide 8061, Elvamide 8064, and Elvamide 8023. One class of alcohol soluble polyamide polymer is disclosed in U.S. Pat. No. 5,709,974, the entire disclosure of which is incorporated herein by reference.

The polyamide should also be soluble in the alcohol solvents employed. Typical alcohols in which the polyamide is soluble include, for example, butanol, ethanol, methanol, and the like. Typical alcohol soluble polyamide polymers having methoxy methyl groups attached to the nitrogen atoms of amide groups in the polymer backbone prior to crosslinking include, for example, hole insulating alcohol soluble polyamide film forming polymers include, for example, Luckamide 5003 from Dai Nippon Ink, Nylon 8 with methylmethoxy pendant groups, CM4000 from Toray Industries, Ltd. and CM8000 from Toray Industries, Ltd., and other N-methoxymethylated polyamides, such as those prepared according to the method described in Sorenson and Campbell "Preparative Methods of Polymer Chemistry" second edition, pg 76, John Wiley & Sons Inc. 1968, and the like, and mixtures thereof. Other polyamides are Elvamides from E.I. Dupont de Nemours & Co. These polyamides can be alcohol soluble, for example, with polar functional groups, such as methoxy, ethoxy and hydroxy groups, pendant from the polymer backbone. These film forming polyamides are also soluble in a solvent to facilitate application by conventional coating techniques. Typical solvents include, for example, butanol, methanol, butyl acetate, ethanol, cyclohexanone, tetrahydrofuran, methyl ethyl ketone, and the like and mixtures thereof.

When the overcoat layer contains only polyamide binder material, the layer tends to absorb moisture from the ambient atmosphere and becomes soft and hazy. This adversely affects the electrical properties, and the sensitivity of the overcoated photoreceptor. To overcome this, the overcoating of this disclosure also includes a dihydroxy arylamine, as disclosed in U.S. Pat. Nos. 5,709,974, 4,871,634 and 4,588,666, the entire disclosures of which are incorporated herein by reference.

The concentration of the hydroxy arylamine in the overcoat can be between about 2 percent and about 50 percent by weight based on the total weight of the dried overcoat. Preferably, the concentration of the hydroxy arylamine in the overcoat layer is between about 10 percent by weight and about 50 percent by weight based on the total weight of the dried overcoat. When less than about 10 percent by weight of hydroxy arylamine is present in the overcoat, a residual voltage may develop with cycling resulting in background problems. If the amount of hydroxy arylamine in the overcoat exceeds about 50 percent by weight based on the total weight of the overcoating layer, crystallization may occur resulting in residual cycle-up. In addition, mechanical properties, abrasive wear properties are negatively impacted.

The thickness of the continuous overcoat layer selected may depend upon the abrasiveness of the charging (e.g., bias charging roll), cleaning (e.g., blade or web), development (e.g., brush), transfer (e.g., bias transfer roll), etc., system employed and can range up to about 10 micrometers. A thickness of between about 1 micrometer and about 5 micrometers in thickness is preferred. Any suitable and conventional technique may be utilized to mix and thereafter apply the overcoat layer coating mixture to the charge generating layer. Typical application techniques include spraying, dip coating, roll coating, wire wound rod coating, and the like. Drying of the deposited coating may be effected by any suitable conventional technique such as oven drying, infrared radiation drying, air drying and the like. The dried overcoating of this disclosure should transport holes during imaging and should not have too high a free carrier concentration. Free carrier concentration in the overcoat increases the dark decay. Preferably the dark decay of the overcoated layer should be the same as that of the unovercoated device.

As described above with respect to the charge transport layer, the POSS modified silicone can be incorporated into the overcoating layer, particularly when it is the external layer of the imaging member. The POSS modified silicone can be suitably mixed with the other components of the overcoating layer for application to the imaging member if the POSS modified silicone has already been formed, or the precursor materials of the POSS modified silicone can be mixed with the other coating materials and applied as a coating solution in which the precursor materials react to form the POSS modified silicone.

The photoreceptors of the present disclosure may comprise, for example, a charge generator layer sandwiched between a conductive surface and a charge transport layer, as described above, or a charge transport layer sandwiched between a conductive surface and a charge generator layer. This structure may be imaged in the conventional xerographic manner, which usually includes charging, optical exposure and development.

Other layers may also be used, such as a conventional electrically conductive ground strip along one edge of the belt or drum in contact with the conductive layer, blocking layer, adhesive layer or charge generating layer to facilitate connection of the electrically conductive layer of the photoreceptor to ground or to an electrical bias. Ground strips are well known and usually comprise conductive particles dispersed in a film forming binder.

In some cases, an anti-curl back coating may be applied to the side opposite the photoreceptor to provide flatness and/or abrasion resistance. These overcoating and anti-curl back coating layers are well known in the art and may comprise thermoplastic organic polymers or inorganic polymers that are electrically insulating or slightly semiconductive. Overcoatings are continuous and generally have a thickness of less than about 10 micrometers.

Any suitable conventional electrophotographic charging, exposure, development, transfer, fixing and cleaning techniques may be utilized to form and develop electrostatic latent images on the imaging member of this disclosure. Thus, for example, conventional light lens or laser exposure systems may be used to form the electrostatic latent image. The resulting electrostatic latent image may be developed by suitable conventional development techniques such as magnetic brush, cascade, powder cloud, and the like.

While the disclosure has been described in conjunction with the specific embodiments described above, it is evident that many alternatives, modifications and variations are apparent to those skilled in the art. Accordingly, the preferred embodiments of the disclosure as set forth above are intended to be illustrative and not limiting. Various changes can be made without departing from the spirit and scope of the disclosure.

An example is set forth hereinbelow and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLES

Example 1

An electrophotographic imaging member is prepared. The imaging member includes a 30 mm diameter mirror substrate, a blocking or undercoating layer, a charge generating layer, a charge transport layer and an overcoating layer. The hole blocking layer is fabricated from a coating dispersion consisting of titanium dioxide ($TiO_2$ STR-60N, Sakai), silica (P-100, Esprit) and phenolic resin (Varcum 29159, Oxy- Chem) in xylene/1-butanol (wt/wt=50/50). The weight ratio of titanium dioxide, silica, phenolic resin is 52/10/38. An aluminum drum substrate of 30 mm in diameter is dip-coated from a dip-coating tank containing the coating solution and dried at a temperature of 145° C. for 45 minutes. The resulting dry blocking layer has a thickness of about 4.0 micrometers. The charge generator coating dispersion is prepared by dispersing 15 grams of chlorogallium phthalocyanine particles in a solution of 10 grams VMCH (available from Union Carbide Co.) in 368 grams of 2:1 mixture of xylene and n-butyl acetate by weight. This dispersion is milled in a Dynomill mill (KDL, available from GlenMill) with 0.4-micrometer zirconium balls for 4 hours. The drum with the hole blocking layer then is dip-coated with the charge generator coating dispersion. The resulting coated drum is air dried to form a 0.2~0.5-micrometer thick charge generating layer.

A charge transporting layer is coated using a solution of a mixture of 60 weight % of PCZ400 (a polycarbonate, available from Mitsubishi Gas Chemical Company, Inc.), and 40 weight % of charge transport molecule N,N'-diphenyl-N,N'-bis(3-methylphenyl)-[1,1'-biphenyl]-4,4'-diamine. The solution is in 70:30 by weight ratio of tetrahydrofuran: toluene solvent mixture, providing an approximate solids content of 23% by weight. The charge transporting layer is air dried at 120° C. for 20 minutes. The dried charge transporting layer thickness is about 22 microns.

An overcoating later is coated over the dried charge transporting layer. The overcoating layer is coated using a solution of a mixture of 70 weight % of PCZ400 (a polycarbonate), and 30 weight % of charge transport molecule N,N'-diphenyl-N,N'-bis(3-methylphenyl)-[1,1'-biphenyl]-4,4'-diamine, which solution further includes 10 wt. % vinyl substituted POSS monomer (available as OL1170 from Hybrid Plastics, Inc.) and 15 wt. % phenyltris(dimethylsilyloxy)silane co-monomer (available from Gelest). The weight percents of the POSS monomer and co-monomer are based on the total weight percent of the PCZ-600 and charge transport molecule. The solution is in 70:30 by weight ratio of tetrahydrofuran:toluene solvent mixture. The overcoating layer solution is mixed by rolling overnight prior to coating to provide a clear solution. Prior to coating, a small amount (~5-10 ppm) of catalyst (platinum carbonyl cyclovinylmethylsiloxane complex available from Gelest) is added. The overcoating layer is dried at 160° C. for 30 minutes. The dried overcoating layer thickness is about 10 microns.

Following completion of the imaging member, the coating appearance of the imaging member charge transfer layer is observed to have a slightly translucent but very uniform appearance. The PIDC curve for the imaging member is also obtained, and various parameters such as $V_{depletion}$ and dark decay are measured.

The thus-formed imaging member is also tested for wear in a bench wear fixture with a BCR roll (available from Hodaka) and toners. The imaging member shows exceptional wear stability, with more uniform wear on the photoreceptor. After 50,000 cycles, wear rate of the imaging member is estimated to be less than 40 nm/kcycles.

Comparative Example 1

An imaging member is made following the same procedures and using the same components as in Example 1, except that the POSS monomer and co-monomer are not included in the overcoating layer. Instead, the overcoating layer solution includes only a mixture of 70 weight % of PCZ400 (a polycarbonate), and 30 weight % of charge transport molecule N,N'-diphenyl-N,N'-bis(3-methylphenyl)-[1,1'-biphenyl]-4,4'-diamine, in 70/30 by weight ratio of tetrahydrofuran:toluene solvent mixture. The overcoating layer solution is applied as in Example 1.

The imaging member is tested using the same tests as in Example 1. The PIDC curve for the imaging member is also obtained, and is found to be essentially the same as the PIDC curve for the imaging member of Example 1.

The thus-formed imaging member is also tested for wear as in Example 1. The imaging member shows good cycling stability, although the wear is worse than in Example 1. After 50,000 cycles, wear of the imaging member is estimated to be about 70 nm/kcycles.

Comparative Example 2

An imaging member is made following the same procedures and using the same components as in Example 1, except that the overcoating layer is omitted entirely.

The imaging member is tested using the same tests as in Example 1. The PIDC curve for the imaging member is also obtained, and is found to be essentially the same as the PIDC curve for the imaging member of Example 1.

The thus-formed imaging member is also tested for wear as in Example 1. The imaging member shows good cycling stability, although the wear is worse than in Comparative Example 1, and much worse than in Example 1. After 50,000 cycles, wear of the imaging member is estimated to be about 90 nm/kcycles.

Example 2

An electrophotographic imaging member is prepared. The imaging member includes a 30 mm diameter mirror substrate, a blocking or undercoating layer, a charge generating layer, and a charge transport layer. The blocking layer and charge generating layer are prepared as in Example 1.

A charge transporting layer is coated using a solution of a mixture of 60 weight % of PCZ400 (a polycarbonate, available from Mitsubishi Gas Chemical Company, Inc.), 40 weight % of charge transport molecule N,N'-diphenyl-N,N'-bis(3-methylphenyl)-[1,1'-biphenyl]-4,4'-diamine, which solution further includes 20 wt. % vinyl substituted POSS monomer (available as OL1170 from Hybrid Plastics, Inc.) and 30 wt. % phenyltris(dimethylsilyloxy)silane co-monomer available from Gelest. The weight percents of the POSS monomer and co-monomer are based on the total weight percent of the PCZ-400 and charge transport molecule. The charge transport layer solution is mixed by rolling overnight prior to coating to provide a clear solution. Prior to coating, a small amount of catalyst (5-10 ppm, platinum carbonyl cyclovinylmethylsiloxane complex available from Gelest) is added. The charge transporting layer is dried at 160° C. for 30 minutes.

Following completion of the imaging member, the coating appearance of the imaging member charge transfer layer is observed to have a slightly translucent but very uniform appearance. The PIDC curve for the imaging member is also obtained, and various parameters such as $V_{depletion}$ and dark decay are measured.

The thus-formed imaging member is also tested for wear in a bench wear fixture with a BCR roll (available from Hodaka) and toners. The imaging member shows exceptional wear stability, with more uniform wear on the photoreceptor. After 50,000 cycles, wear rate of the imaging member is estimated to be less than 40 nm/kcycles.

Example 3

An imaging member is made following the same procedures and using the same components as in Example 2, except that the charge transporting layer coating solution is a mixture of 60 weight % of PCZ400 (a polycarbonate), 40 weight % of charge transport molecule N,N'-diphenyl-N,N'-bis(3-methylphenyl)-[1,1'-biphenyl]-4,4'-diamine, which solution further includes 10 wt. % vinyl substituted POSS monomer available as OL1170 from Hybrid Plastics, Inc. and 15 wt. % phenyltris(dimethylsiloxy)silane co-monomer available from Gelest. The weight percents of the POSS monomer and co-monomer are based on the total weight percent of the PCZ-400 and charge transport molecule.

The imaging member is tested using the same tests as in Example 2. The PIDC curve for the imaging member is also obtained, and is found to be essentially the same as the PIDC curve for the imaging member of Example 2.

The thus-formed imaging member is also tested for wear as in Example 2. The imaging member shows exceptional wear stability, with more uniform wear on the photoreceptor. After 50,000 cycles, wear of the imaging member is estimated to be about 40 nm/kcycles.

Comparative Example 3

An imaging member is made following the same procedures and using the same components as in Example 2, except that the POSS monomer and co-monomer are not included in the charge transport layer.

The imaging member is tested using the same tests as in Example 2. The PIDC curve for the imaging member is also obtained, and is found to be essentially the same as the PIDC curve for the imaging member of Example 2.

The thus-formed imaging member is also tested for wear as in Example 2. The imaging member shows good cycling stability, although the wear is worse than in Example 2. After 50,000 cycles, wear of the imaging member is estimated to be about 90 nm/kcycles.

What is claimed is:

1. An imaging member comprising:

a substrate, a charge generating layer, and a charge transport layer, wherein an external layer of said imaging member comprises a polyhedral oligomeric silsesquioxane modified silicone dispersed therein.

2. The imaging member of claim 1, wherein said external layer is said charge transport layer.

3. The imaging member of claim 1, further comprising an overcoating layer over said charge transport layer, and said external layer is said overcoating layer.

4. The imaging member of claim 1, wherein said polyhedral oligomeric silsesquioxane modified silicone is in a form of an interpenetrating network in said external layer.

5. The imaging member of claim 1, wherein said polyhedral oligomeric silsesquioxane modified silicone is formed by a reaction selected from the group consisting of:

a hydrosilation reaction of a substituted polyhedral oligomeric silsesquioxane monomer with a hydridosilane or a hydride functional siloxane polymer, a peroxide activated cure reaction of a vinyl-substituted polyhedral oligomeric silsesquioxane monomer with at least one member selected from the group consisting of a polysiloxane, a vinyl-terminated polysiloxane, and a siloxane-vinyl-terminated siloxane copolymer, or a sol-gel reaction of at least one monomer selected from the group consisting of an alkoxysilane-substituted polyhedral oligomeric silsesquioxane, a silanol-substituted polyhedral oligomeric silsesquioxane, and a chlorosilane-substituted polyhedral oligomeric silsesquioxane with at least one member selected from the group consisting of an alkoxysilane, a chlorosilane, a silanol-terminated polysiloxane.

6. The imaging member of claim 1, wherein said polyhedral oligomeric silsesquioxane modified silicone is formed by a hydrosilation reaction of a substituted polyhedral oligomeric silsesquioxane monomer with a hydridosilane or a hydride functional siloxane polymer.

7. The imaging member of claim 6, wherein said substituted polyhedral oligomeric silsesquioxane monomer is a compound of the formula $(RSiO_{1.5})_n$ where n is an even number and R is selected from the group consisting of substituted or unsubstituted aliphatic or aromatic hydrocarbon groups.

8. The imaging member of claim 6, wherein said substituted polyhedral oligomeric silsesquioxane monomer is a compound of the formula:

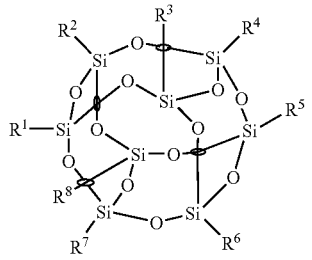

wherein n is an even number and each of $R^1$, $R^2$, $R^3$, $R^4$, $R^5$, $R^6$, $R^7$, and $R^8$, which can be the same or different, are selected from the group consisting of substituted or unsubstituted aliphatic or aromatic hydrocarbon groups, which can be cyclic, branched or straight chained and can be saturated or unsaturated.

9. The imaging member of claim 6, wherein said hydridosilane is a compound of the formula:

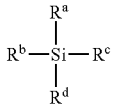

wherein each of $R^a$, $R^b$, $R^c$, and $R^d$ is, independently, selected from the group consisting of H, linear $C_{1-30}$ alkyl, branched $C_{1-30}$ alkyl, cyclic $C_{3-30}$ alkyl, linear $C_{2-30}$ alkenyl, branched $C_{2-30}$ alkenyl, linear $C_{2-30}$ alkynyl, branched $C_{2-30}$ alkynyl, $C_{6-20}$ aralkyl, $C_{6-10}$ aryl, and a polymeric moiety having a molecular weight of about 1000 to about 100,000, wherein each of $R^a$, $R^b$, $R^c$, and $R^d$ is optionally substituted with one or more substituents selected from the group consisting of —F, —Cl, —Br, —CN, —$NO_2$, =O, —N=C=O, —N=C=S,

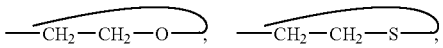

—$N_3$, —$NR^eR^f$, —$SR^g$, —$OR^h$, —$CO_2R^i$, —$PR^jR^kR^l$, —$P(OR^m)(OR^n)(OR^p)$, —$P(=O)(OR^q)(OR^s)$, —$P(=O)_2OR^t$, —$OP(=O)_2OR^u$, —$S(=O)_2R^v$, —$S(=O)R^w$, —$S(=O)_2OR^x$, —$C(=O)NR^yR^z$, and —$OSiR^{aa}R^{bb}R^{cc}$, where each of $R^e$, $R^f$, $R^g$, $R^h$, $R^i$, $R^j$, $R^k$, $R^l$, $R^m$, $R^n$, $R^p$, $R^q$, $R^s$, $R^t$, $R^u$, $R^v$, $R^w$, $R^x$, $R^y$, and $R^z$, is, independently, H, linear $C_{1-10}$ alkyl, branched $C_{1-10}$ alkyl, cyclic $C_{3-8}$ alkyl, linear $C_{2-10}$ alkenyl, branched $C_{2-10}$ alkenyl, linear $C_{2-10}$ alkynyl, branched $C_{2-10}$ alkynyl, $C_{6-12}$ or $C_{6-10}$ aryl, and is optionally substituted with one or more substituents selected from the group consisting of —F, —Cl, and —Br, where each of $R^{aa}$, $R^{bb}$, and $R^{cc}$ is, independently, linear $C_{1-10}$ alkyl, branched $C_{1-10}$ alkyl, cyclic $C_{3-8}$ alkyl, linear $C_{2-10}$ alkenyl, branched $C_{2-10}$ alkenyl, linear $C_{2-10}$ alkynyl, branched $C_{2-10}$ alkynyl, $C_{6-12}$ aralkyl, $C_{6-10}$ aryl, —F, —Cl, —Br, or $OR^{dd}$, where $R^{dd}$ is linear $C_{1-10}$ alkyl or branched $C_{1-10}$ alkyl, and wherein at least one of $R^a$, $R^b$, $R^c$, and $R^d$ is H and at least one of $R^a$, $R^b$, $R^c$, and $R^d$ is not H.

10. The imaging member of claim 6, wherein said substituted polyhedral oligomeric silsesquioxane monomer is a vinyl substituted polyhedral oligomeric silsesquioxane monomer and said hydridosilane is selected from the group consisting of phenyltris(dimethylsiloxy)silane, tris(dimethylsilyloxy)methylsilane, 1,3-dicyclohexyl-1,1,3,3-tetrakis(dimethylsilyloxy)disiloxane, 1,1,3,3-tetramethyldisiloxane, 1,1,3,3,5,5-hexamethyltrisiloxane, and 1,4-bis(dimethylsilyl)benzene.

11. The imaging member of claim 6, wherein said substituted polyhedral oligomeric silsesquioxane monomer is a vinyl substituted polyhedral oligomeric silsesquioxane monomer and said hydride functional siloxane polymer is selected from the group consisting of hydride-terminated polydimethylsiloxane, methylhydrosiloxane-dimethylsiloxane copolymer, polymethylhydrosiloxane, polyethylhydrosiloxane, hydride-terminated polyphenyl(dimethylhydrosiloxy)siloxane, hydride-terminated methylhydrosiloxane-phenylmethylsiloxane copolymer, methylhydrosiloxane-octylmethylsiloxane copolymer, and hydride Q resin.

12. The imaging member of claim 1, wherein said external layer further comprises a binder material and an arylamine charge transport material.

13. An electrographic image development device, comprising the imaging member of claim 1.

14. A process for forming an imaging member, comprising:

providing an imaging member substrate, and applying at least a charge generating layer and a charge transport layer to said substrate, wherein an external layer of said imaging member comprises a polyhedral oligomeric silsesquioxane modified silicone dispersed therein.

15. The process of claim 14, wherein said external layer is said charge transport layer.

16. The process of claim 14, further comprising applying an overcoating layer over said charge transport layer, and wherein said external layer is said overcoating layer.

17. The process of claim 14, wherein said polyhedral oligomeric silsesquioxane modified silicone is formed by a hydrosilation reaction of a substituted polyhedral oligomeric silsesquioxane monomer with a hydridosilane.

18. The process of claim 17, wherein said substituted polyhedral oligomeric silsesquioxane monomer is a compound of the formula $(RSiO_{1.5})_n$ where n is an even number and R is selected from the group consisting of substituted or unsubstituted aliphatic or aromatic hydrocarbon groups.

19. The process of claim 17, wherein said substituted polyhedral oligomeric silsesquioxane monomer is a compound of the formula:

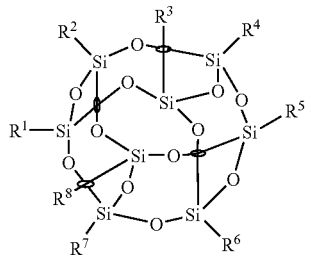

wherein n is an even number and each of $R^1$, $R^2$, $R^3$, $R^4$, $R^5$, $R^6$, $R^7$, and $R^8$, which can be the same or different, are selected from the group consisting of substituted or unsubstituted aliphatic or aromatic hydrocarbon groups, which can be cyclic, branched or straight chained and can be saturated or unsaturated.

20. The process of claim 17, wherein said hydridosilane is a compound of the formula:

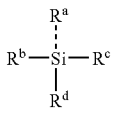

wherein each of $R^a$, $R^b$, $R^c$, and $R^d$ is, independently, selected from the group consisting of H, linear $C_{1-30}$ alkyl, branched $C_{1-30}$ alkyl, cyclic $C_{3-30}$ alkyl, linear $C_{2-30}$ alkenyl, branched $C_{2-30}$ alkenyl, linear $C_{2-30}$ alkynyl, branched $C_{2-30}$ alkynyl, $C_{6-20}$ aralkyl, $C_{6-10}$ aryl, and a polymeric moiety having a molecular weight of about 1000 to about 100,000, wherein each of $R^a$, $R^b$, $R^c$, and $R^d$ is optionally substituted with one or more substituents selected from the group consisting of —F, —Cl, —Br, —CN, —$NO_2$, =O, —N=C=O, —N=C=S,

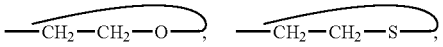

—$N_3$, —$NR^eR^f$, —$SR^g$, —$OR^h$, —$CO_2R^i$, —$PR^jR^kR^l$, —$P(OR^m)(OR^n)(OR^p)$, —$P(=O)(OR^q)(OR^s)$, —$P(=O)_2OR^t$, —$OP(=O)_2OR^u$, —$S(=O)_2R^v$, —$S(=O)R^w$, —$S(=O)_2OR^x$, —$C(=O)NR^yR^z$, and —$OSiR^{aa}R^{bb}R^{cc}$, where each of $R^e$, $R^f$, $R^g$, $R^h$, $R^i$, $R^j$, $R^k$, $R^l$, $R^m$, $R^n$, $R^p$, $R^q$, $R^s$, $R^t$, $R^u$, $R^v$, $R^w$, $R^x$, $R^y$, and $R^z$, is, independently, H, linear $C_{1-10}$ alkyl, branched $C_{1-10}$ alkyl, cyclic $C_{3-8}$ alkyl, linear $C_{2-10}$ alkenyl, branched $C_{2-10}$ alkenyl, linear $C_{2-10}$ alkynyl, branched $C_{2-10}$ alkynyl, $C_{6-12}$ aralkyl, or $C_{6-10}$ aryl, and is optionally substituted with one or more substituents selected from the group consisting of —F, —Cl, and —Br, where each of $R^{aa}$, $R^{bb}$, and $R^{cc}$ is, independently, linear $C_{1-10}$ alkyl, branched $C_{1-10}$ alkyl, cyclic $C_{3-8}$ alkyl, linear $C_{2-10}$ alkenyl, branched $C_{2-10}$ alkenyl, linear $C_{2-10}$ alkynyl, branched $C_{2-10}$ alkynyl, $C_{6-12}$ aralkyl, $C_{6-10}$ aryl, —F, —Cl, —Br, or $OR^{dd}$, where $R^{dd}$ is linear $C_{1-10}$ alkyl or branched $C_{1-10}$ alkyl, and wherein at least one of $R^a$, $R^b$, $R^c$, and $R^d$ is H and at least one of $R^a$, $R^b$, $R^c$, and $R^d$ is not H.

21. The process of claim 17, wherein said substituted polyhedral oligomeric silsesquioxane monomer is a vinyl substituted polyhedral oligomeric silsesquioxane monomer and said hydridosilane is phenyltris(dimethylsiloxy)silane, tris(dimethylsilyloxy)methylsilane, 1,3-dicyclohexyl-1,1,3,3-tetrakis(dimethylsilyloxy)disiloxane, 1,1,3,3-tetramethyldisiloxane, 1,1,3,3,5,5-hexamethyltrisiloxane, 1,4-bis(dimethylsilyl)benzene.

22. The process of claim 14, wherein said external layer is formed by applying a coating solution comprising a substituted polyhedral oligomeric silsesquioxane monomer, at least one of a hydridosilane and a hydride functional siloxane polymer, and an optional catalyst.

23. The process of claim 14, wherein said polyhedral oligomeric silsesquioxane modified silicone is formed by a hydrosilation reaction of a substituted polyhedral oligomeric silsesquioxane monomer with a hydride functional siloxane polymer.

* * * * *